US009726371B2

(12) United States Patent
Lin et al.

(10) Patent No.: US 9,726,371 B2
(45) Date of Patent: Aug. 8, 2017

(54) GLASS AND METAL BURNER CAP AND METHOD OF MAKING THE SAME

(71) Applicant: Whirlpool Corporation, Benton Harbor, MI (US)

(72) Inventors: Yen-Hsi Lin, Saint Joseph, MI (US); Gilius A. Gaska, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 539 days.

(21) Appl. No.: 14/264,557

(22) Filed: Apr. 29, 2014

(65) Prior Publication Data

US 2014/0331989 A1 Nov. 13, 2014

Related U.S. Application Data

(60) Provisional application No. 61/820,863, filed on May 8, 2013.

(51) Int. Cl.
*F24C 3/08* (2006.01)
*F23D 14/06* (2006.01)

(52) U.S. Cl.
CPC ..... *F23D 14/06* (2013.01); *F24C 3/085* (2013.01); *F23D 2212/00* (2013.01); *Y10T 29/49348* (2015.01)

(58) Field of Classification Search
CPC ..... F23D 14/06; F23D 2212/00; F24C 3/085; Y10T 29/49348
USPC ..... 126/211, 217, 220, 218, 214 D
See application file for complete search history.

(56) References Cited

U.S. PATENT DOCUMENTS

| | | | | |
|---|---|---|---|---|
| 3,555,651 | A | 1/1971 | Latussek et al. | |
| 3,793,701 | A | 2/1974 | Chartet | |
| 3,835,832 | A * | 9/1974 | Welcker | F24C 15/10 126/215 |
| 4,610,069 | A | 9/1986 | Darbois | |
| 4,878,434 | A | 11/1989 | Sommet | |
| 6,209,534 | B1 * | 4/2001 | Taplan | F23D 14/06 126/214 A |
| 6,927,370 | B2 | 8/2005 | McClure et al. | |
| 7,263,757 | B2 | 9/2007 | Herman | |
| 7,290,318 | B2 | 11/2007 | Bradley et al. | |
| 2010/0175446 | A1 * | 7/2010 | Jones | B21D 26/14 72/54 |

FOREIGN PATENT DOCUMENTS

| | | |
|---|---|---|
| GB | 896923 | 5/1962 |
| WO | WO0150065 A1 * | 7/2001 |

* cited by examiner

*Primary Examiner* — Avinash Savani
*Assistant Examiner* — Rabeeul Zuberi

(57) ABSTRACT

A gas burner assembly may include a gas burner and a burner cap. The burner may include a distribution cavity fluidly coupled with a gas inlet and a plurality of gas discharge ports. The burner cap may have a glass body characterized by a peripheral edge, and a metal element encapsulating the peripheral edge. The glass body may overlie at least a portion of the distribution cavity, and the metal element may shield the peripheral edge.

18 Claims, 10 Drawing Sheets

GLASS AND METAL BURNER CAP AND METHOD OF MAKING THE SAME

CROSS-REFERENCE TO RELATED APPLICATIONS

The present application claims the benefit of U.S. Provisional Patent Application No. 61/820,863, filed May 8, 2013, which is hereby incorporated by reference in its entirety.

BACKGROUND OF THE INVENTION

Burner caps are used on gas cookstoves to collect and evenly distribute the gas for combustion externally of the cap. Known burner caps are made of materials amenable to die casting and stamping, such as iron, steel excluding stainless steel, and related alloys. Known burner caps may be painted in black, unpainted, or partially or fully encased in a thin overlay of a typically metallic material. However, the appearance of painted and unpainted caps may deteriorate with use. The thin overlay may be difficult and costly to produce, particularly if the overlay is to have a complex configuration or embossed detailing.

BRIEF DESCRIPTION OF THE INVENTION

A gas burner assembly may include a gas burner and a burner cap. The burner may include a distribution cavity fluidly coupled with a gas inlet and a plurality of gas discharge ports. The burner cap may have a glass body characterized by a peripheral edge, and a metal element encapsulating the peripheral edge. The glass body may overlie at least a portion of the distribution cavity, and the metal element may shield the peripheral edge.

DETAILED DESCRIPTION OF EMBODIMENTS OF THE INVENTION

Figure 1A:
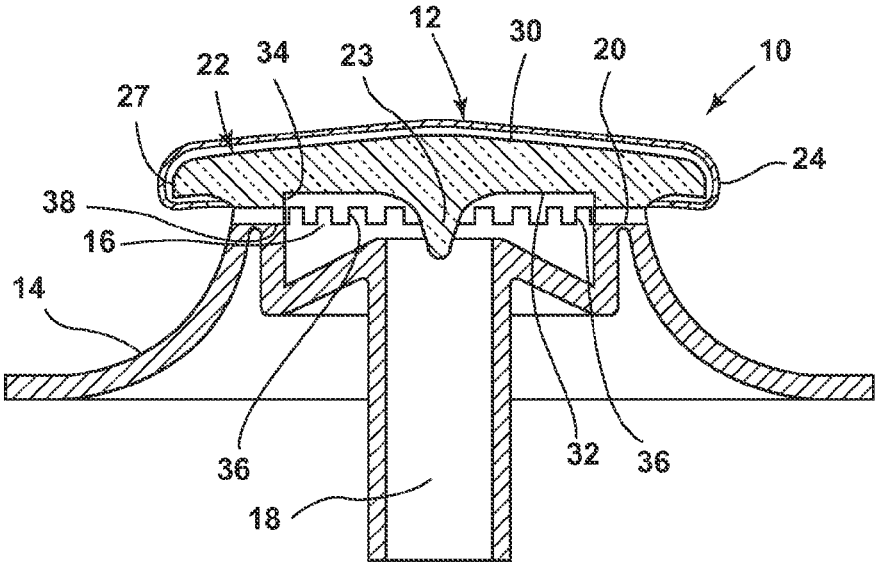
FIG. 1A is a vertical sectional view of a gas stove burner assembly comprising a gas burner body, a burner cap, and an overlying encapsulating metal element conforming to the burner cap according to an exemplary embodiment of the invention.
Figure 1B:
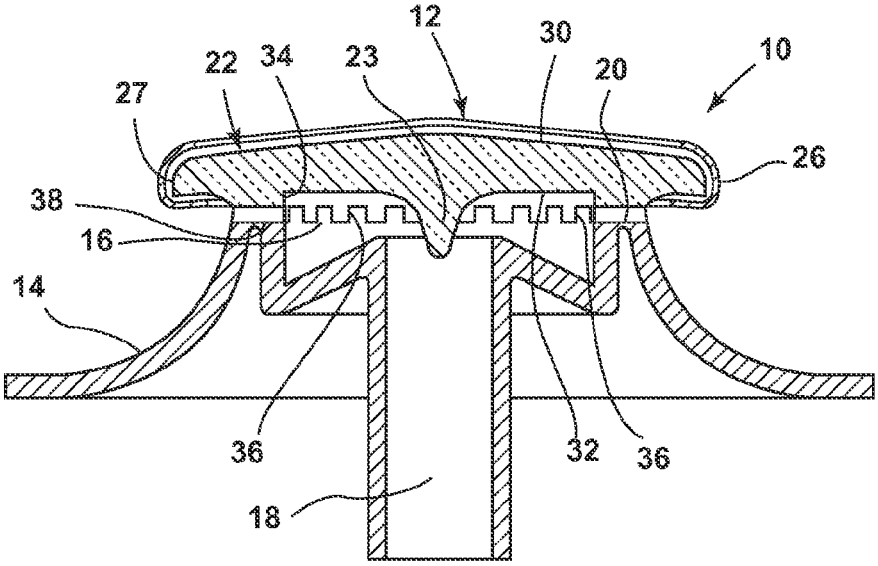
FIG. 1B is a vertical sectional view of a gas stove burner assembly as illustrated in FIG. 1A with a ring metal element conforming to a peripheral edge of the burner cap.

Referring to the Figures, and particularly to FIGS. 1A and 1B, an exemplary representation of a gas stove burner assembly 10 is illustrated, including an encapsulated burner cap assembly 12 according to an embodiment of the invention. The encapsulated burner cap assembly 12 may be configured for operational registry with a gas burner body 14 including a gas distribution cavity 16 fluidly coupled with a gas supply inlet 18. The gas burner body 14 may terminate in an annular surface 20 encircling an upper terminus of the interior gas cavity 16. The gas burner body 14 may have a generally circular cross-section, although other section configurations, such as oval, square, rectangular, and the like, may be utilized.

The encapsulated burner cap assembly 12 may include a burner cap 22 having a burner cap body 23 fabricated of a glass-ceramic, a borosilicate glass, a metal, other non-metallic materials, and the like, exhibiting resistance to thermal shock and high contact temperature suitable for the purposes described herein. For exemplification, the burner cap 22 will be considered a circular glass-ceramic or borosilicate glass. The burner cap body 23 may be encapsulated by an overlying disc metal element 24, or a ring metal element 26 over a circular peripheral edge 27, as hereinafter described. The glass burner cap 22 may have a coefficient of thermal expansion that, for all practicable purposes, is equal to, or approaches, zero. Alternatively, the glass burner cap 22 may be selected to have a coefficient of thermal expansion sufficiently lower than the disc/ring metal element 24/26, respectively, to minimize thermal expansion incompatibilities between the glass and the metal.

The burner cap body 23 may be somewhat plate-like having a somewhat convex obverse surface 30 and an opposed reverse surface 32 having a somewhat irregular profile. The burner cap body 23 may be characterized as terminating in the circular peripheral edge 27 extending radially beyond the annular surface 20 of the gas burner body 14.

The reverse surface 32 may transition near the peripheral edge 27 to an annular boss 34 terminating in an annular surface 38 configured for registry with the annular surface 20. The annular boss 34 may be castellated with a plurality of regularly spaced teeth 35 and gas discharge ports 36. When the burner cap 22 is placed on the gas burner body 14 so that the annular boss 34 is in registry with the annular surface 20, each pair of adjacent teeth 35 and the annular surface 20 may define the gas discharge ports 36 in fluid communication with the gas distribution cavity 16. Gas may then flow outward from the gas distribution cavity 16 through the gas discharge ports 36, where the gas may be ignited.

Figure 2A:
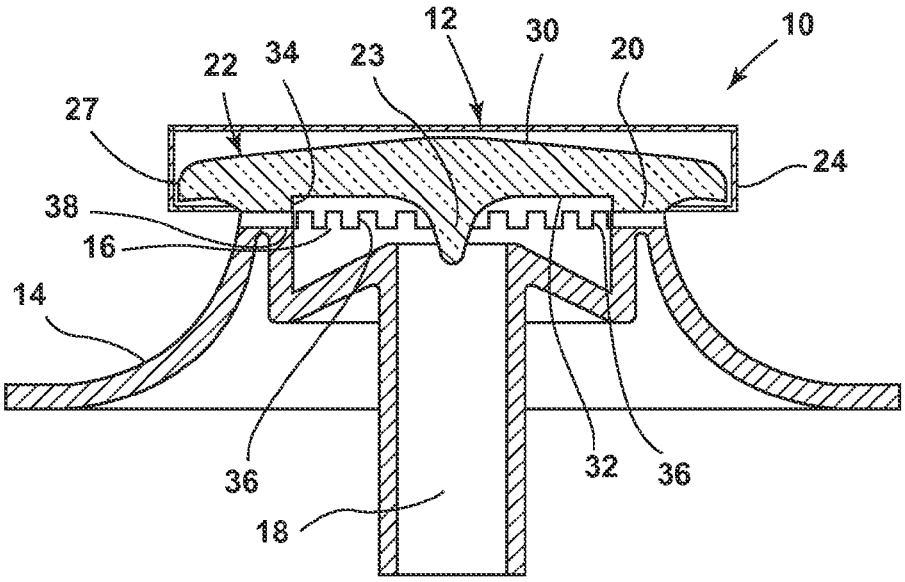
FIG. 2A is a vertical sectional view of a gas stove burner assembly as illustrated in FIG. 1A with an overlying encapsulating metal element prior to an encapsulation process.
Figure 2B:
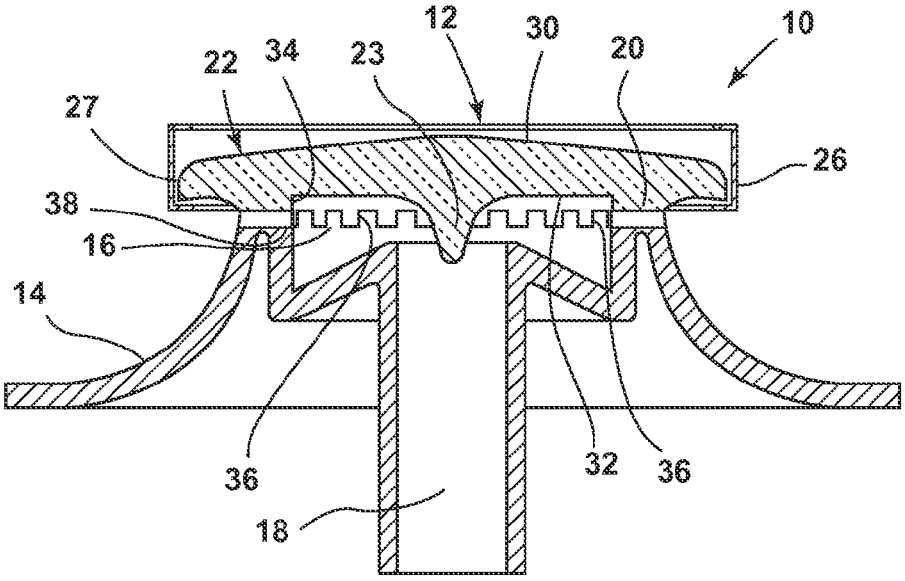
FIG. 2B is a vertical sectional view of a gas stove burner assembly as illustrated in FIG. 1B with a ring metal element prior to an encapsulation process.

FIGS. 1A and 1B illustrate a disc metal element 24 and a ring metal element 26, respectively, after encapsulation, as hereinafter described. FIGS. 2A and 2B illustrate one example of the disc metal element 24 and the ring metal element 26, respectively, prior to encapsulation. Encapsulation of the burner cap 22 as illustrated in FIGS. 1A and 1B will be described with reference to a preceding step illustrated by FIGS. 2A and 2B. The disc metal element 24 is illustrated in FIG. 1A as separated somewhat from the glass burner cap 22 for purposes of clarity, with the understanding that the disc metal element 24 may be placed in total intimate registry with the glass burner cap 22, as hereinafter described. Likewise, the ring metal element 26 is illustrated in FIG. 1B as separated somewhat from the circular peripheral edge 27 for purposes of clarity, with the understanding that the ring metal element 26 may be closely wrapped in total intimate registry around the circular peripheral edge 27, as hereinafter described.

As illustrated in FIG. 2A, in one embodiment the disc metal element 24 may be positioned relative to the burner cap 22 to extend along and under the peripheral edge 27 prior to encapsulation. As illustrated in FIG. 2B, in a similar embodiment the ring metal element 26 may be positioned over, along, and under the peripheral edge 27 prior to encapsulation. The disc metal element 24 and the ring metal element 26 may encapsulate the burner cap 22 and peripheral edge 27, respectively, by moving the metal element 24, 26, or portions of the metal element, at a speed great enough to plastically flow the metal element around the burner cap 22 and peripheral edge 27, respectively. High velocity movement and plastic flow of the metal element 24, 26 may be effected as generally described hereinafter.

Figure 3:
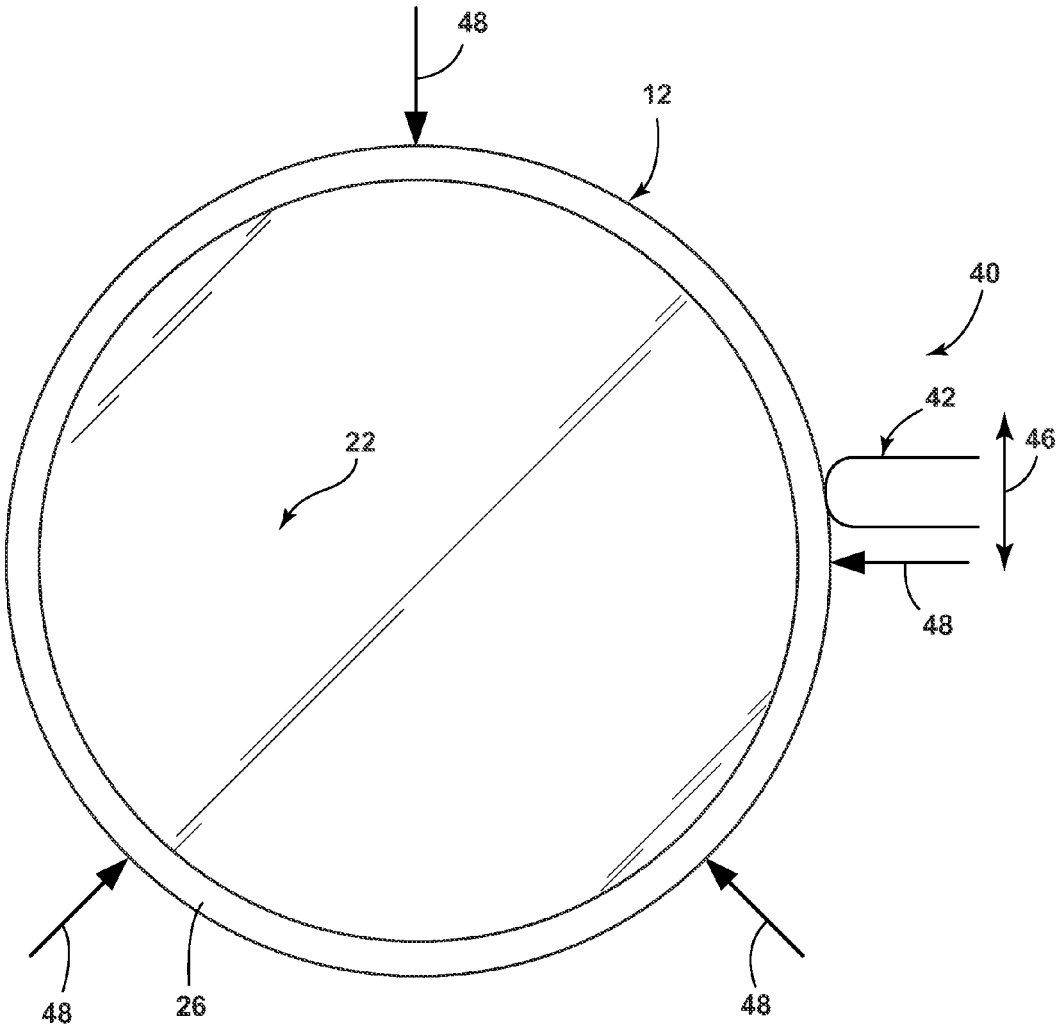
FIG. 3 is a schematic plan view representation of the burner cap and ring metal element as illustrated in FIGS. 2A and 2B during an encapsulation process by an electromagnetic coil assembly.

Referring to FIG. 3, high-velocity metal forming may move metal, such as the exemplary ring metal element 26, at a speed such that the metal plastically flows. It should be noted that, while the following description is directed to a ring metal element, the disc metal element or any other metal element configuration, may be formed in generally the same manner. For most metals, speeds greater than about 100 meters/second (m/s) may result in plastic flowing of the metal. These speeds may be about at least 100 times faster than traditional stamping/press break speeds, which are about 1 m/s. Energy for forming the metal at high velocity may be generated by a high-voltage instantaneous controlled release of electric current from a bank of capacitors (not shown) to create a high-intensity electromagnetic force field.

Electromagnetic energy may be utilized to reshape portions of the exemplary ring metal element 26 without the need for molds, dies, anvils, and the like. For example, the glass burner cap 22 and ring metal element 26 may be placed in a cap installation setup 40 and positioned to receive electromagnetic force, as exemplified by the electromagnetic force vectors 48, from an electromagnetic coil 42 as the coil 42 moves circumferentially around the ring metal element 26, as shown by the coil translation vector 46. A high-intensity electromagnetic force field may be generated, and the ring metal element 26 may be selectively introduced into the force field, which may bend or fold the ring metal element 26 in a preselected manner around the peripheral edge 27 of the burner cap 22. It may not be practicable to bend the entire metal element 24/26 into a final configuration at a single application of the electromechanical force. It may be necessary to form selected sections sequentially. The effect of the force field may selectively move portions of the ring metal element 26 at a high velocity, due to plastic flow in the ring metal element 26, and bending of the ring metal element around the peripheral edge 27.

Alternatively, high-pressure waves may be directed toward selected areas of a metal element 24, 26 to impact the selected areas and bend the metal element, or drive the metal element, around the burner cap 22 and/or peripheral edge 27. High-pressure waves may be generated by a high-voltage instantaneous controlled release of electric current from a bank of capacitors (not shown) to trigger controlled generation of high velocity movement and plastic flow of the metal element 24, 26.

Figure 4:
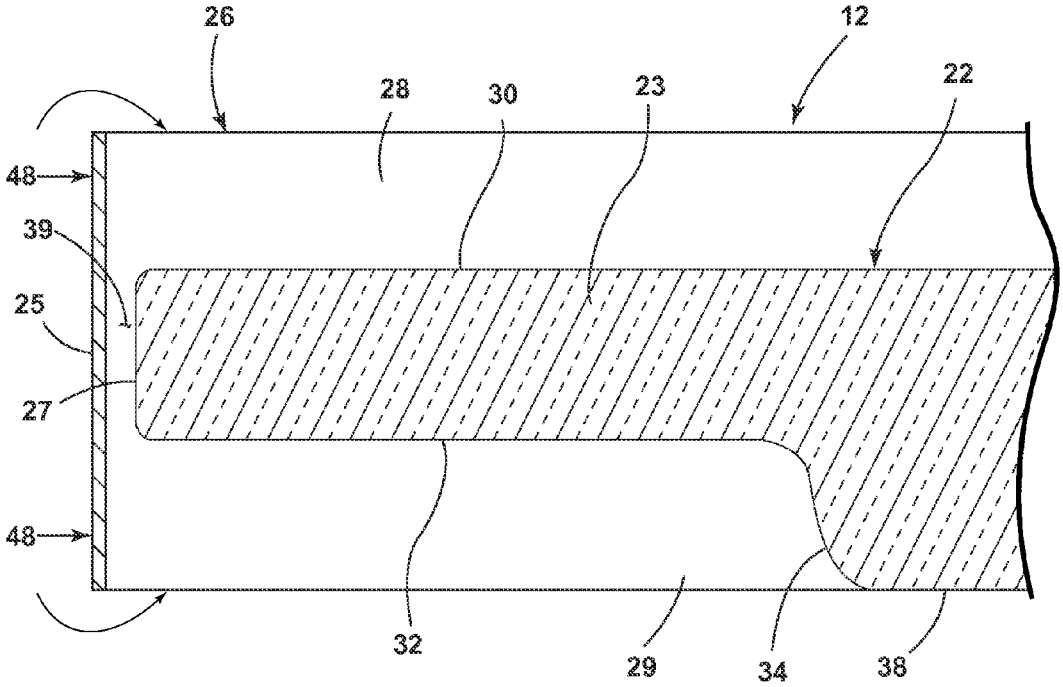
FIG. 4 is an enlarged vertical sectional view of a portion of the encapsulated burner cap assembly as illustrated in FIGS. 1B and 2B showing an alignment of the ring metal element with the peripheral edge of the burner cap.

FIG. 4 illustrates an encapsulation of the ring metal element 26 about a peripheral edge 27. The ring metal element 26 is a generally thin ring-shaped body defining a peripheral edge shield 25, an obverse flange 28, and a reverse flange 29. The obverse flange 28 may be disposed adjacent the obverse surface 30, and the reverse flange 29 may be disposed adjacent the reverse surface 32. The peripheral edge shield 25 may be disposed adjacent the peripheral edge 27. The obverse flange 28 may be bent along the obverse surface 30 by the electromagnetic force generated by the electromagnetic coil 42. The reverse flange 29 may be bent along the reverse surface 32 by the electromagnetic force generated by the electromagnetic coil 42 acting on the reverse flange 29. As a result, for example, the obverse flange 28 may overlie a portion of the obverse surface 30, the reverse flange 29 may overlie a portion of the reverse surface 32, and the peripheral edge shield 25 may overlie the peripheral edge 27. The glass burner cap 22 and the ring metal element 26 may have different coefficients of thermal expansion. The ring metal element 26 may be configured relative to the peripheral edge 27 to define an annular gap 39 between the peripheral edge shield 25 and the peripheral edge 27. The consequential difference in expansion and contraction movement between the glass burner cap 22 and the ring metal element 26 may be accommodated by the annular gap 39.

Figure 5:
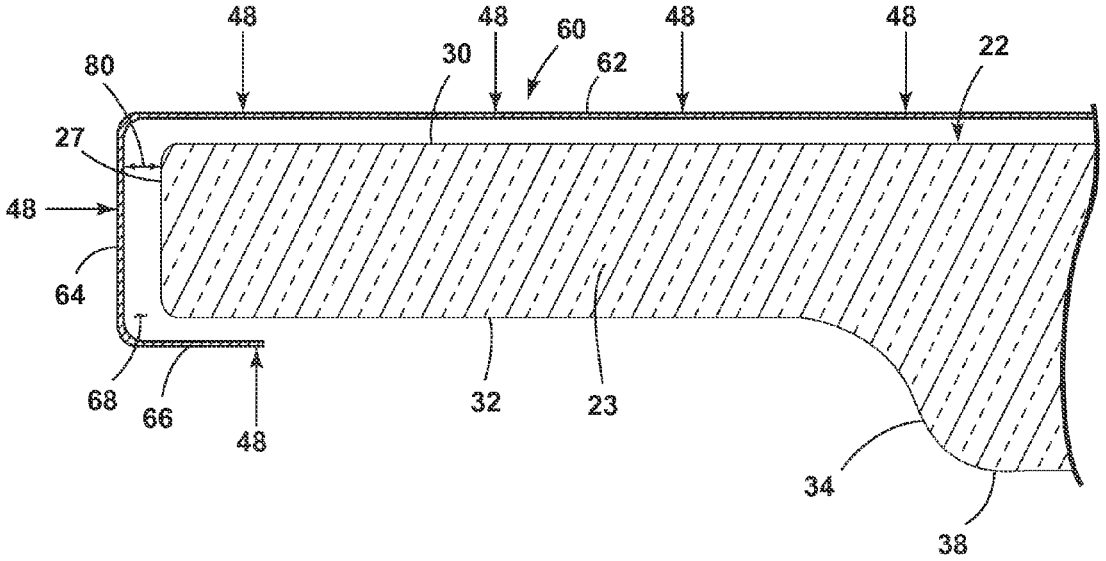
FIG. 5 is an enlarged vertical sectional view of a portion of the encapsulated burner cap assembly as illustrated in FIGS. 1A and 2A showing an alignment of the overlying encapsulating metal element with the burner cap.
Figure 6A:
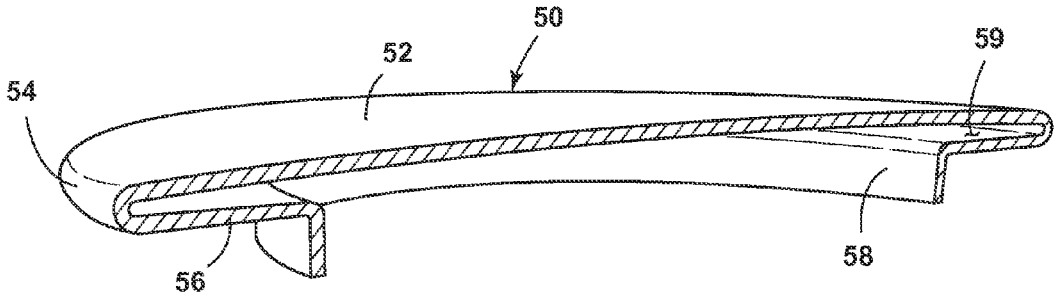
FIGS. 6A, 6B, and 6C are perspective partially vertical sectional views of alternative exemplary embodiments of the overlying encapsulating metal element.
Figure 6B:
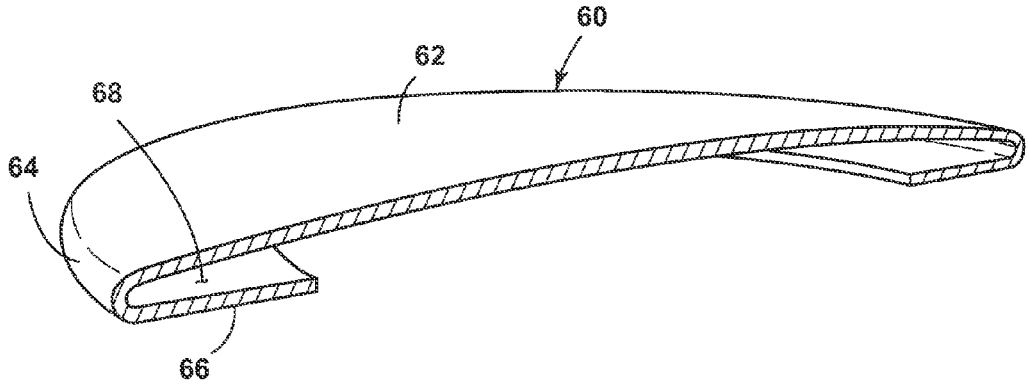

FIG. 5 illustrates an encapsulation of the disc metal element 24, exemplified by an open metal element 60, which is also illustrated in FIG. 6B, disposed over the burner cap 22 and about the peripheral edge 27. The open metal element 60 may include an obverse disc portion 62 overlying the obverse surface 30, transitioning to a circumferential edge 64 overlying the peripheral edge 27, in turn transitioning to an encapsulation flange portion 66 overlying a portion of the reverse surface 32.

Electromagnetic force, represented by the electromagnetic force vectors 48, may move the obverse disc portion 62 against the obverse surface 30, the encapsulation flange portion 66 against a portion of the reverse surface 32, and the circumferential edge 64 adjacent the peripheral edge 27 to define an annular gap 80. The glass burner cap 22 and the open metal element 60 may have different coefficients of thermal expansion. The consequential difference in expansion and contraction movement between the glass burner cap 22 and the open metal element 60 may be accommodated by the annular gap 80. Positioning of the open metal element 60 over and around the burner cap 22 may be effected by preparing the encapsulating flange portion 66 and the circumferential edge 64 as a continuous annular skirt extending away from the obverse disc portion 62, placing the open metal element 60 over the burner cap 22 so that the skirt may surround the glass burner cap 22, and moving the encapsulating flange portion 66 against the portion of the reverse surface 32 after the positioning of the open metal element 60.

Figure 6C:
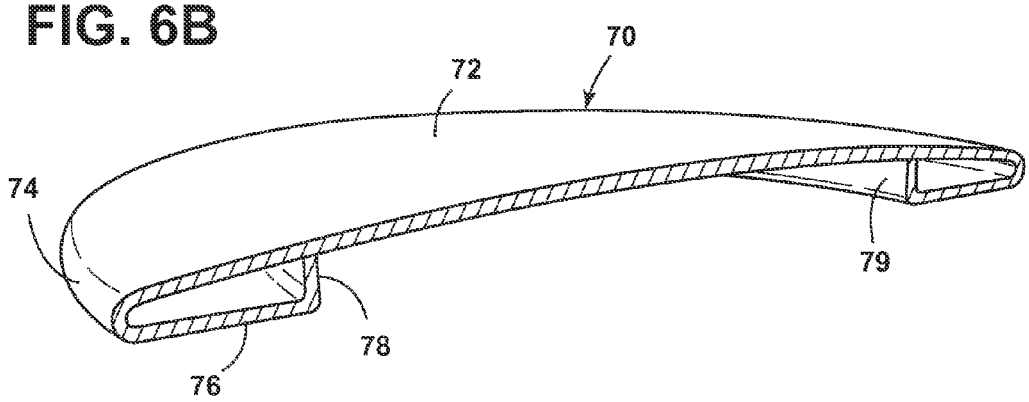

FIGS. 6A, 6B, and 6C illustrate alternate metal elements. Flanged metal element 50 may include an obverse disc portion 52 transitioning to a circumferential edge 54, in turn transitioning to an encapsulation flange portion 56, transitioning to an annular flange 58 extending away from the obverse disc portion 52. The encapsulation flange portion 56 and obverse disc portion 52 may define a burner cap receptacle 59 for encapsulation of the peripheral edge 27. Open metal element 60 may include an obverse disc portion 62 transitioning to a circumferential edge 64, in turn transitioning to an encapsulation flange portion 66. The encapsulation flange portion 66 and obverse disc portion 62 may define a burner cap receptacle 68 for encapsulation of the peripheral edge 27. Closed metal element 70 may include an obverse disc portion 72 transitioning to a circumferential edge 74, in turn transitioning to a ring flange portion 76 transitioning to an annular wall 78 extending from the ring flange portion 76 to the obverse disc portion 72. The annular wall 78 may define a circular cap receptacle 79 for seating over a burner cap 22.

Figure 7:
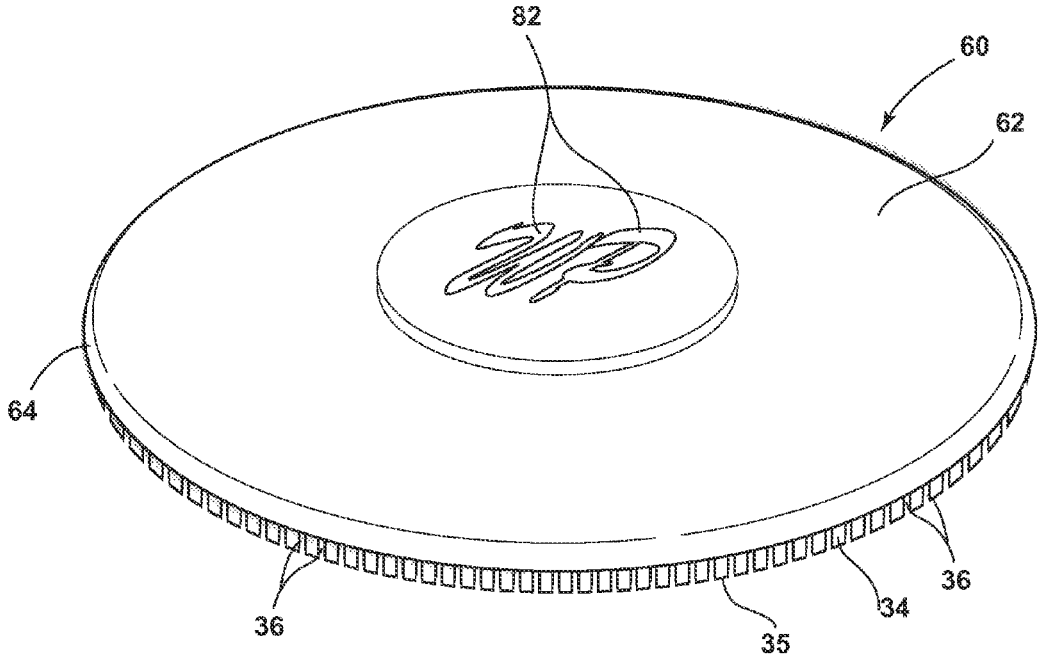
FIG. 7 is a perspective view of $6^{th}$ exemplary embodiment of an encapsulated burner cap having an annular boss with a plurality of regularly spaced gas discharge ports and an obverse surface embossment.

FIG. 7 illustrates the open metal element 60 with the obverse disc portion 62 capped by a circular raised embossment 82. The raised embossment 82 may reflect a circular raised embossment (not shown) on the glass burner cap 22, which may be revealed by the high velocity metal forming process described above.

Figure 8A:
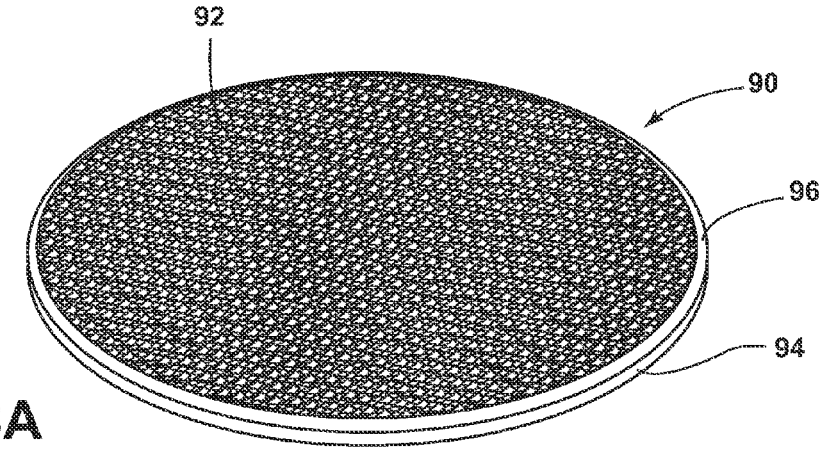
FIGS. 8A, 8B, and 8C are perspective views of alternative exemplary embodiments of a glass burner cap having encapsulating metal elements.

FIG. 8A illustrates an encapsulated burner cap assembly 90 that may include a glass burner cap 92 underlain by a reverse surface disc element 96 having an annular ring element 94 wrapping around the peripheral edge 27. The glass burner cap 92 may be smooth, or embossed with a selected pattern on the obverse surface 30. The glass burner cap 92 may be non-opaque, opaque, colored, texturized, and the like.

Figure 8B:
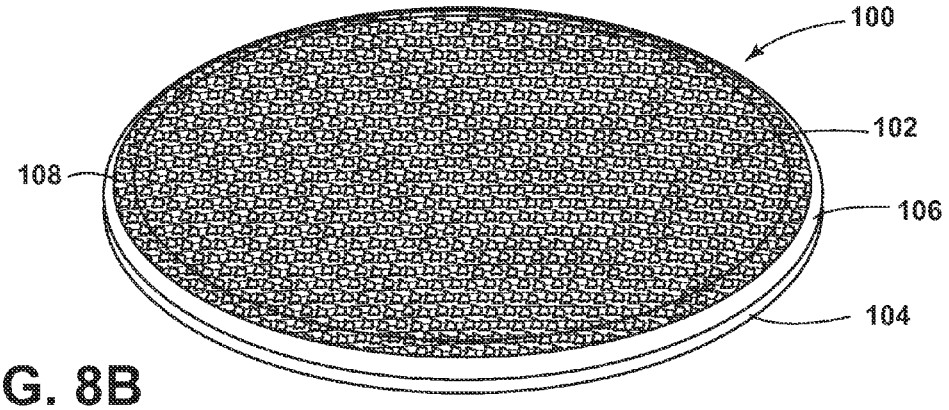

FIG. 8B illustrates an encapsulated burner cap assembly 100 that may include a glass burner cap 102 and an annular ring metal element 104 that may encapsulate the peripheral edge 27, terminating in a ring element flange 106 overlying the obverse surface 30. The glass burner cap 102 may be smooth, embossed, non-opaque, opaque, colored, texturized, and the like.

Figure 8C:
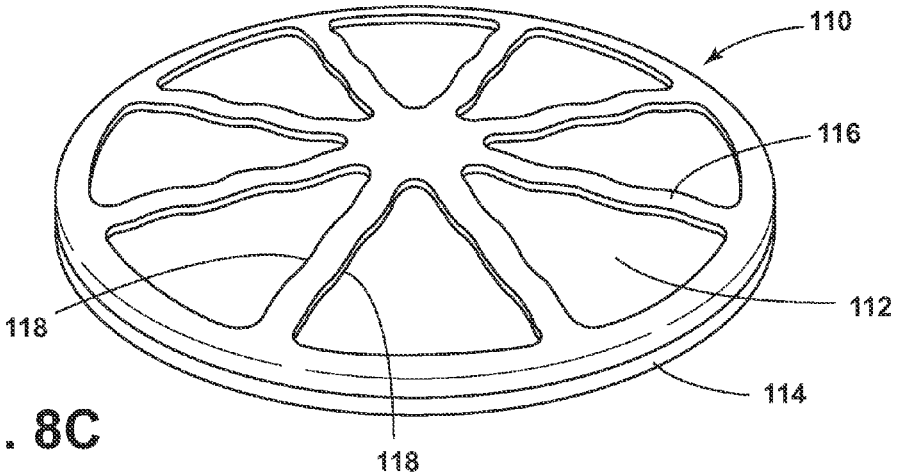
Figure 9:
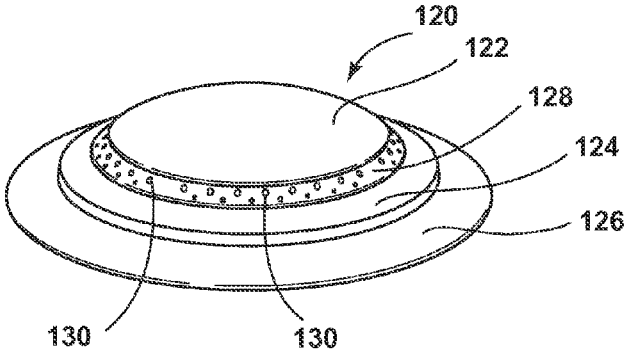
FIG. 9 is a perspective view of a sealed burner cap assembly according to a $10^{th}$ exemplary embodiment of the gas stove burner assembly.
Figure 10:
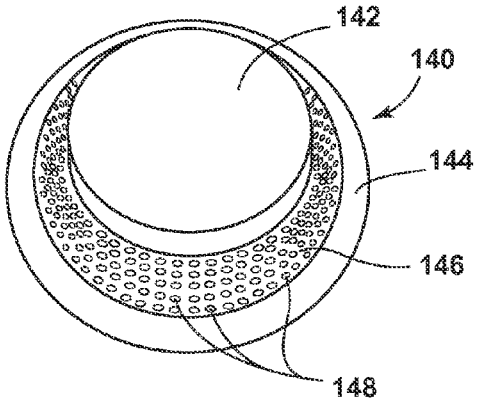
FIG. 10 is a perspective view of a sealed burner cap assembly according to an $11^{th}$ exemplary embodiment of the gas stove burner assembly.
Figure 11:
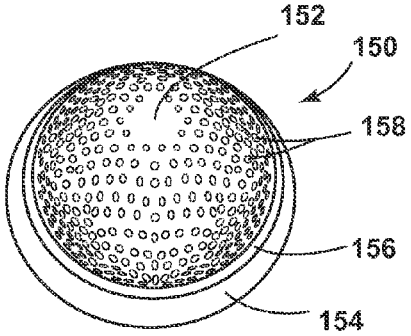
FIG. 11 is a perspective view of a spherical burner cap assembly according to a $12^{th}$ exemplary embodiment of the gas stove burner assembly.
Figure 12:
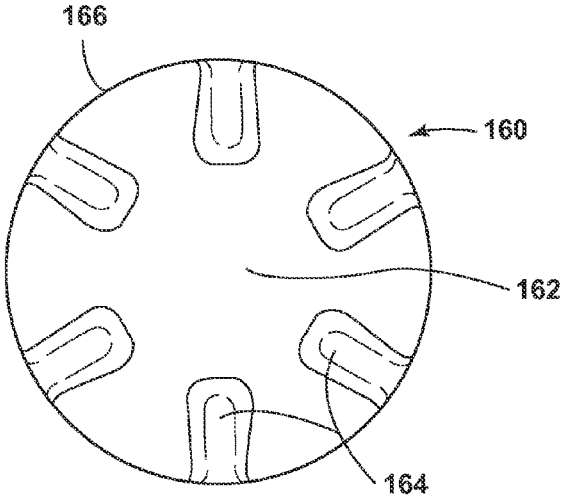
FIG. 12 is a perspective view of an embossed burner cap assembly according to a $13^{th}$ exemplary embodiment of the gas stove burner assembly.

FIG. 8C illustrates an encapsulated burner cap assembly 110 that may include a glass burner cap 112 overlain by a spoked obverse surface disc element 116 defining a plurality of wedge shaped element openings 118. The disc element 116 may transition to an annular metal portion 114 encapsulating the peripheral edge 27. The glass burner cap 112 may be smooth, embossed, non-opaque, opaque, colored, texturized, and the like. The spokes 116 and wedge shaped element openings 118 may be formed prior to the high velocity metal forming process described above, leaving only encapsulation of the peripheral edge 27 and movement of the spoked obverse surface disc element 116 against the glass burner cap 112.

FIGS. 9, 10, 11, and 12 illustrate alternative embodiments of burner cap assemblies providing selected gas flame configurations. For example, sealed burner cap assembly 120 may include a burner cap 122 transitioning to a seal ring 124, in turn transitioning to an escutcheon 126. Between the burner cap 122 and the seal ring 124, a burner ring 128 may extend, having a plurality of gas ports 130. The gas ports 130 may be in a selected configuration to provide an ornamental gas flame. Low-profile burner cap assembly 140 may include a cylindrical burner cap 142 transitioning to an escutcheon 144. Between the cylindrical burner cap 142 and escutcheon 144, a burner ring 146 may extend, having a plurality of gas ports 148 in a selected configuration to provide an ornamental gas flame.

Burner cap assemblies, such as those illustrated in FIGS. 9, 10, 11, and 12, may include stainless steel burner caps comprising an anti-yellowing clear coat. Stainless steel may provide an enhanced surface aesthetic, while enabling precise forming, punching, crimping, and embossment. An anti-yellowing clear coat may preserve the look of stainless steel, and electromagnetic metal forming may provide precision in ornamental flame configurations. Examples of a suitable anti-yellowing clear coat may include a silica based coating made by a sol-gel process. The coating may principally comprise silicon dioxide ($SiO_2$). Alternatively, zirconium oxide ($ZrO_2$), or a combination of oxides, such as $SiO_2$ and titanium dioxide ($TiO_2$) may be utilized. An example of a coating supplier is Sumitomo Chemical Company, LTD. of Tokyo, JP. The coating may be spray coated or used in a dip coating process after the forming process, or may be applied utilizing a coil coat process prior to forming.

Spherical burner cap assembly 150 may include a spherical burner cap 152, transitioning to an escutcheon 154 through a ring metal element 156. The burner cap 152 may include a plurality of gas ports 158 in a selected configuration to provide an ornamental ball-shaped gas flame. The burner cap assemblies 120, 140, and 150 may include burner caps 122, 142, 152 that may be smooth, embossed, non-opaque, opaque, colored, texturized, and the like.

Embossed encapsulated burner cap assembly 160 may include an encapsulating disc metal element 162 having embossments 164 that may reflect an underlying burner cap. The embossments 164 may be in a selected configuration, for example, extending radially to a circumferential edge 166.

Figure 13:
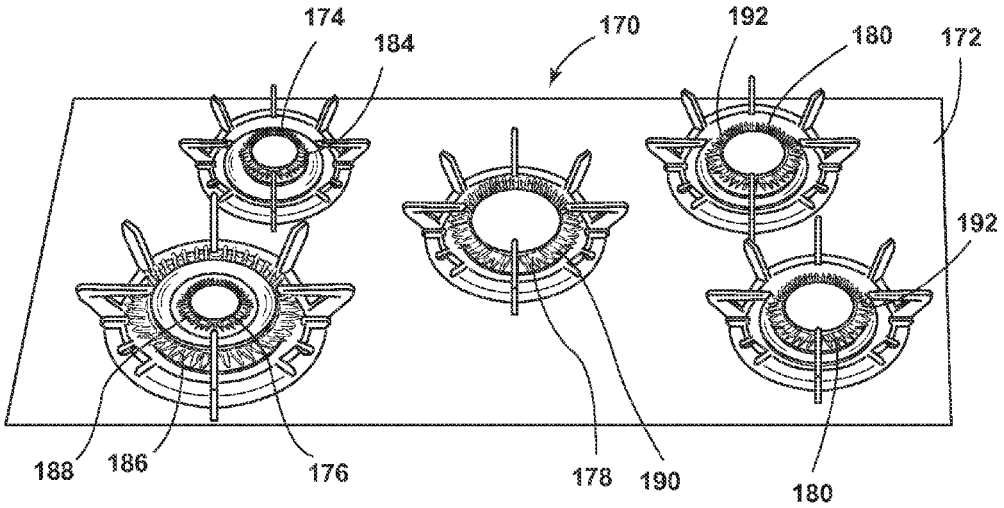
FIG. 13 is a perspective view of a portion of a gas range burner assembly illustrating burner cap assemblies according to different embodiments of a gas stove burner assembly.

FIG. 13 illustrates a gas range assembly 170 having a range surface 172 and a plurality of burner assemblies with different flame configurations. Burner assembly 174 may have a small gas flame 184. Burner assembly 176 may have an outer gas flame 186 and an inner gas flame 188. Burner assembly 178 may have a large gas flame 190. Burner assemblies 180 may have intermediate gas flames 192.

Figure 14:
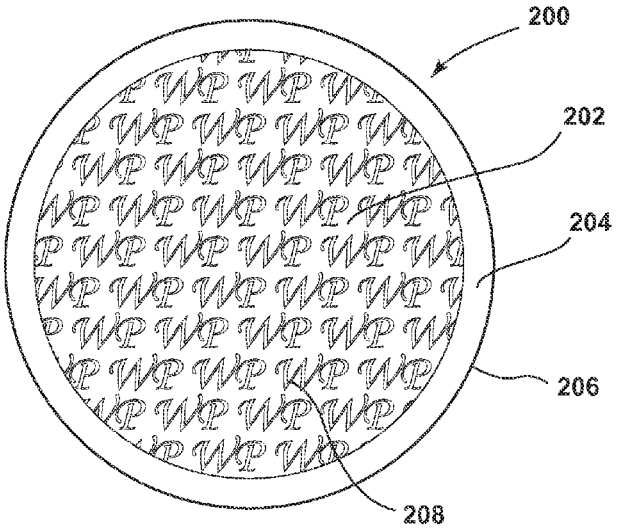
FIG. 14 is a plan view of an embossed burner cap assembly according to a $14^{th}$ exemplary embodiment of the gas stove burner assembly.

FIG. 14 illustrates an alternative embossed burner cap assembly 200. Burner cap assembly 200 may include an embossed burner cap 202 encapsulated with a ring metal element 204 with a circumferential edge 206, and an embossment 208 that may be non-opaque, opaque, colored, texturized, and the like.

While the invention has been specifically described in connection with certain specific embodiments thereof, it may be to be understood that this may be by way of illustration and not of limitation. Reasonable variation and modification are possible within the scope of the forgoing disclosure and drawings without departing from the spirit of the invention which may be defined in the appended claims.

What is claimed is:

1. A gas burner assembly comprising:

a gas burner having a distribution cavity, a gas inlet fluidly coupled to the distribution cavity, and a plurality of discharge ports; and a burner cap comprising a glass body having a peripheral edge, and a metal element surrounding the peripheral edge;

wherein the glass body overlies at least a portion of the distribution cavity and the metal element shields the peripheral edge; and wherein the metal element is spaced from the peripheral edge to define a gap into which the peripheral edge may extend in response to thermal expansion of the glass body.

2. The gas burner assembly of claim 1 wherein the glass body has an upper and a lower surface, with the lower surface facing the distribution cavity.

3. The gas burner assembly of claim 2 wherein the metal element extends from the upper surface to the lower surface.

4. The gas burner assembly of claim 3 wherein the metal element overlies the lower surface.

5. The gas burner assembly of claim 1 wherein the metal element and glass body have different coefficients of thermal expansion.

6. The gas burner assembly of claim 1 wherein the glass body is non-opaque.

7. The gas burner assembly of claim 1 wherein the glass body is embossed.

8. The gas burner assembly of claim 1 wherein the metal element is attached to the glass body by moving portions of the metal element at a speed great enough to flow plastically about at least a portion of the peripheral edge.

9. The gas burner assembly of claim 8 wherein the metal element is spaced from the peripheral edge to define a gap into which the peripheral edge may extend in response to thermal expansion of the glass body.

10. A method of making a glass burner cap for a gas burner assembly having a gas burner with a distribution cavity and a plurality of discharge ports fluidly coupled to the distribution cavity, the method comprising encapsulating a peripheral edge of the glass burner cap with a metal element.

11. The method of claim 10 wherein the encapsulating comprises moving at least a portion of the metal element at a speed great enough to plastically flow the metal.

12. The method of claim 10 wherein the encapsulating comprises encapsulating at least a portion of a lower surface of the glass burner cap.

13. The method of claim 12 wherein the encapsulating comprises encapsulating all of the lower surface of the glass burner cap.

14. The method of claim 12 wherein the encapsulating comprises encapsulating at least a portion of an upper surface of the glass burner cap.

15. The method of claim 14 wherein the encapsulating comprises leaving a gap between the peripheral edge and the metal element.

16. The method of claim 15 further comprising applying a tarnish-resistant coating to the metal element.

17. The method of claim 1 wherein the encapsulating comprises leaving a gap between the peripheral edge and the metal element.

18. The method of claim 1 further comprising embossing the metal element.

* * * * *